US010780364B2

(12) United States Patent
Bearsch et al.

(10) Patent No.: US 10,780,364 B2
(45) Date of Patent: Sep. 22, 2020

(54) CHILDREN'S TOY FOR PROMOTING MOVEMENT

(71) Applicant: Skip Hop, Inc., New York, NY (US)

(72) Inventors: Benjamin Bearsch, Brooklyn, NY (US); Hui Jin, New York, NY (US); Janet Villano, Jersey City, NJ (US)

(73) Assignee: SKIP HOP, INC., New York, NY (US)

( * ) Notice: Subject to any disclaimer, the term of this patent is extended or adjusted under 35 U.S.C. 154(b) by 157 days.

(21) Appl. No.: 15/641,919

(22) Filed: Jul. 5, 2017

(65) Prior Publication Data

US 2019/0009183 A1 Jan. 10, 2019

(51) Int. Cl.

| | |
|---|---|
| ***A63H 17/395*** | (2006.01) |
| ***A63H 33/00*** | (2006.01) |
| ***A63B 21/068*** | (2006.01) |
| ***A63H 3/00*** | (2006.01) |
| ***A63H 3/28*** | (2006.01) |
| ***A63H 11/00*** | (2006.01) |

(52) U.S. Cl.

CPC ..... *A63H 33/006* (2013.01); *A63B 21/068* (2013.01); *A63H 3/006* (2013.01); *A63H 3/28* (2013.01); *A63H 11/00* (2013.01); *A63H 33/005* (2013.01); *A63H 33/007* (2013.01); *A63B 2208/12* (2013.01)

(58) Field of Classification Search

CPC .... A63H 33/00; A63H 33/005; A63H 33/006; A63H 33/007; A63H 17/00; A63H 17/395; A63B 2208/12

USPC ..... 446/227, 436, 437, 454, 457, 460, 431

See application file for complete search history.

(56) References Cited

U.S. PATENT DOCUMENTS

| | | | | | |
|---|---|---|---|---|---|
| 2,840,949 | A * | 7/1958 | Faulkner | A63H 5/00 | 446/265 |
| 4,662,856 | A * | 5/1987 | Getgey | A63H 17/25 | 446/280 |
| 4,712,184 | A * | 12/1987 | Haugerud | B25J 5/007 | 377/16 |
| 5,533,920 | A * | 7/1996 | Arad | A63H 33/005 | 446/409 |
| 5,697,829 | A * | 12/1997 | Chainani | A63H 17/395 | 446/436 |
| 6,027,395 | A * | 2/2000 | Strom | A63H 11/10 | 446/269 |
| 6,083,104 | A * | 7/2000 | Choi | A63H 17/004 | 446/436 |
| 6,227,933 | B1 * | 5/2001 | Michaud | A63H 33/005 | 446/458 |

(Continued)

FOREIGN PATENT DOCUMENTS

WO WO 2016174494 A1 * 11/2016 ..... A63H 33/005

*Primary Examiner* — Alexander R Niconovich

(74) *Attorney, Agent, or Firm* — Stephen J. Weyer, Esq.; James R. Hayne, Esq.; Stites & Harbison, PLLC

(57) ABSTRACT

A children's toy includes a base having an upper portion and a lower portion and a driving mechanism operably connected to the lower portion of the base. The driving mechanism is configured to move the base along a plurality of paths. One or more lights operably connected to the base are configured to display a patterned light display as the base moves along one of a plurality of paths. A removable member is also included for placement on the base with a sensor on the base triggered by the removable member which affects the path of the base.

19 Claims, 7 Drawing Sheets

(56) References Cited

U.S. PATENT DOCUMENTS 6,354,842 B1 * 3/2002 Frei ..... A63H 17/25 434/258
6,632,122 B2 * 10/2003 Klitsner ..... A63H 17/395 446/441
6,964,572 B2 * 11/2005 Cesa ..... A63H 11/00 434/258
7,033,243 B2 * 4/2006 Hornsby ..... A63H 3/48 446/175
7,037,171 B2 * 5/2006 Clark ..... A63H 7/04 446/308
7,927,170 B2 * 4/2011 Bickerton ..... A63H 11/02 446/175
8,347,823 B1 * 1/2013 Thomas ..... A01K 15/025 119/707
8,894,465 B2 * 11/2014 McClintock ..... A63H 11/02 446/431
2008/0166946 A1 * 7/2008 Gallagher ..... A63H 17/06 446/428
2010/0062681 A1 * 3/2010 Yang ..... A63H 11/10 446/465
2010/0063628 A1 * 3/2010 Landry ..... G05D 3/12 700/258
2011/0269374 A1 * 11/2011 Hornsby ..... A63H 18/16 446/484
2013/0084773 A1 * 4/2013 Mimlitch, III ..... A63H 11/02 446/391
2015/0298016 A1 * 10/2015 Rehkemper ..... A63H 29/20 446/463
2016/0235270 A1 * 8/2016 Santini ..... A47L 9/0411
2017/0036349 A1 * 2/2017 Dubrovsky ..... B25J 9/162
2017/0196196 A1 * 7/2017 Trottier ..... A01K 5/0283
2017/0197146 A1 * 7/2017 Miller ..... A63F 13/215
2018/0049613 A1 * 2/2018 Tsuboi ..... A47L 9/2852
2018/0290067 A1 * 10/2018 Miller ..... A63H 11/00

* cited by examiner

CHILDREN'S TOY FOR PROMOTING MOVEMENT

FIELD OF INVENTION

The present invention relates to a children's toy for promoting movement and in particular a toy which has a base that moves along a path and includes a removable member.

BACKGROUND OF THE INVENTION

Typically, most babies learn to crawl between the ages of 7 months and 10 months. One known way to encourage crawling is to place toys just beyond the child's reach. Upon reaching the toy, however, the child will no longer be incentivized to continue moving, requiring a parent to take the toy away from the child and place it at another location. As children become more proficient in moving, and even begin walking, it becomes increasingly difficult to continually move these toys away from the child.

SUMMARY OF THE INVENTION

The present invention relates to a children's toy for promoting movement. The toy of the present invention includes a base configured to move along a path and a removable member configured for placement on the base.

The base includes a housing which is formed by an upper portion and a lower portion that mate together to define an internal cavity, as further discussed below. More specifically, in one exemplary embodiment, the upper portion and the lower portion of the base are joined with a bumper located between the upper portion and the lower portion, and a set of ribbons connected to the housing adjacent to the bumper and extending away from the rear of the housing.

The upper portion of the housing defines a cradle located substantially in the center of the upper portion of the housing with the cradle configured to house the removable member. Within the cradle are two actuating pins which, when the removable member is positioned within the cradle, move up and down to alternately engage the removable member, causing the removable member to bob up and down within the cradle. Furthermore, a button switch is positioned within the cradle such that when the removable member is positioned within the cradle, the removable member depresses the button switch. As such, the button switch provides feedback as to whether the removable member is positioned within the cradle, as further discussed below.

The lower portion of the housing includes a driving mechanism configured to move the base along a path. In one particular embodiment, the driving mechanism includes a first driving wheel and a second driving wheel positioned on either side of the lower portion of the housing and which are each individually controllable. At the front of the lower portion is a pivot wheel in the form of swivel caster which freely rotates in all directions and which helps support the base while moving along the path.

The housing defines an internal cavity which contains various elements for controlling operation of the base. In particular, the housing contains a first motor operably connected to the first driving wheel, a second motor operably connected to the second driving wheel, a CPU for controlling each of the motors, and a power source, such as batteries, for providing power to each of the motors. The housing further contains one or more lights visible through the upper portion of the housing and a speaker for playing sounds and/or music. A slide switch located on exterior of the housing provides a means to not only to activate/deactivate the toy, but also to switch between multiple modes of use thereof, as further described below.

In some exemplary embodiments, the removable member includes a substantially spherical body which is weighted to maintain an upright position when placed on a substantially flat surface. On the exterior of the spherical body and opposite the offset weight, i.e., on an upper side of the spherical body, are a plurality of engagement features. In any event, the removable member is configured for placement on the base, and in particular, within the cradle defined in the upper portion of the housing.

In a first mode of operation, when the removable member is positioned within the cradle, the base moves along a first path, which, in some embodiments, is substantially circular. In a second mode of operation, when the removable member is positioned within the cradle, the base moves along a second path, which, in some embodiments, is substantially random. If the removable member is subsequently removed from the cradle while the base is moving along the first path or the second path, the base will begin rotating in place. Likewise, if the removable member is not positioned within the cradle when the slide switch is first moved from an "off" position to an "on" position (i.e., either the first mode of operation or a the second mode of operation), the base will rotate in place. Upon placing the removable member within the cradle, the base will begin to move along the first path or the second path, depending on which of the two modes of operation the toy is set.

BRIEF DESCRIPTION OF THE DRAWINGS

The present invention will now be described with regard to the drawings as follows.

DETAILED DESCRIPTION

Figure 1:
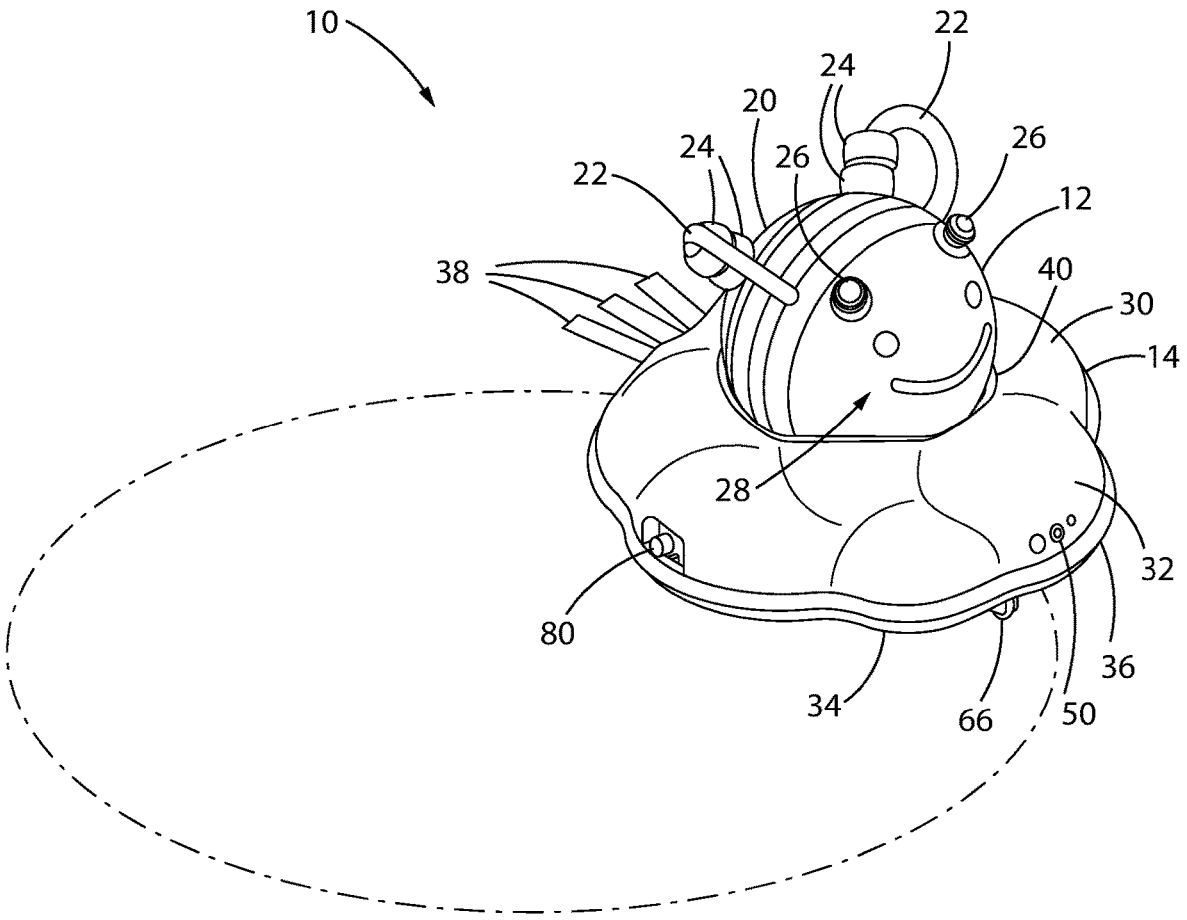
FIG. 1 is a perspective view of an children's toy in accordance with the present invention moving along a first path.

The present invention will now be described with reference to the figures. The children's toy 10 made in accordance with the present invention includes a base 14 and a removable member 12 configured for placement on the base 14.

The base 14 includes a housing 30 which is formed by an upper portion 32 and a lower portion 34 that mate together to define an internal cavity, as further discussed below. More specifically, in the exemplary base 14 shown in the Figures, the upper portion 32 and the lower portion 34 are joined with a bumper 36 located between the upper portion 32 and the lower portion 34, and a set of ribbons 38 connected to the housing 30 adjacent to the bumper 36 and extending away from the rear of the housing 30. Proximity sensors 50 are located at the front of the housing 30, as further discussed below.

Figure 3:
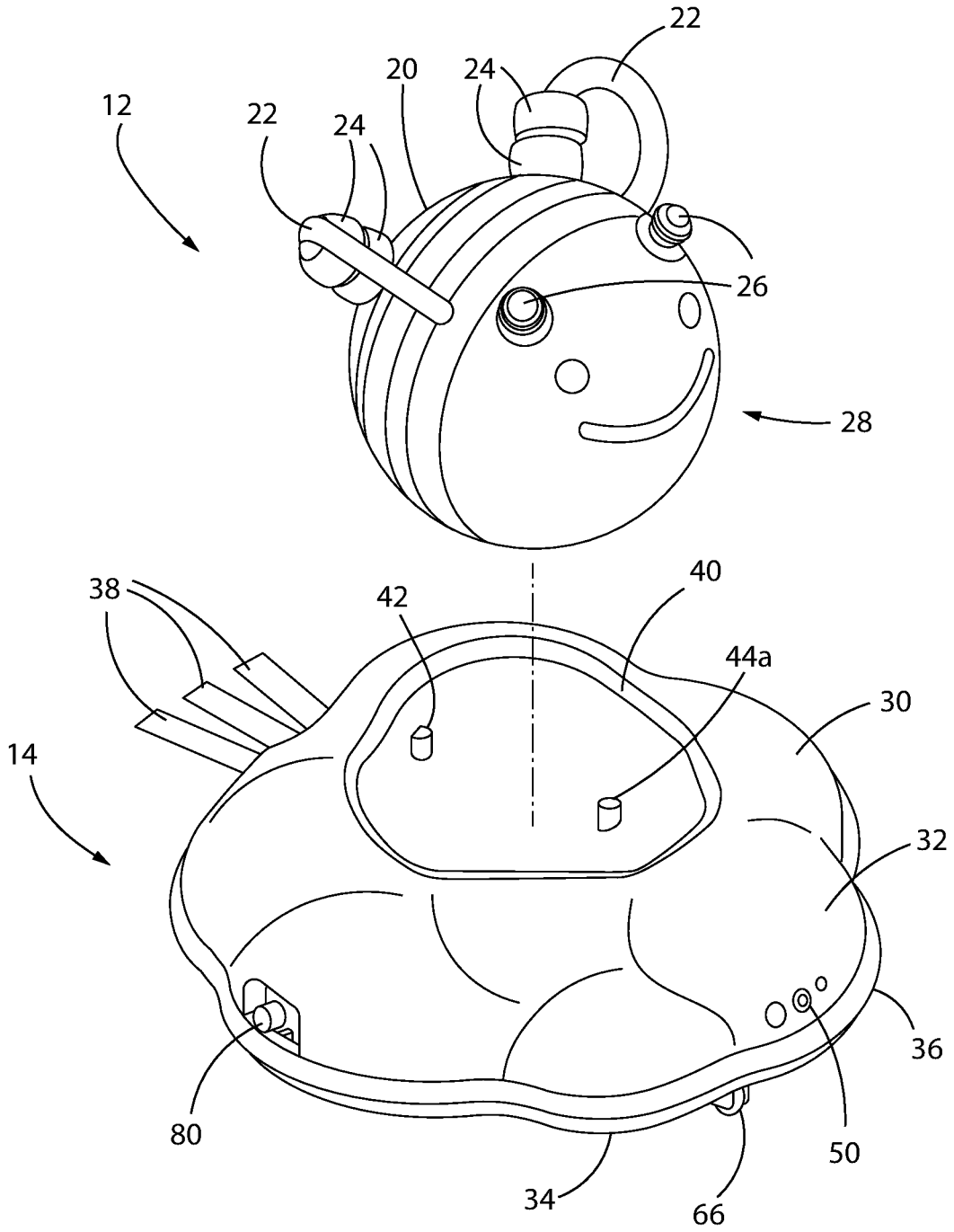
FIG. 3 is a perspective view of the children's toy of FIG. 1 with the removable member positioned away from the base.
Figure 4:
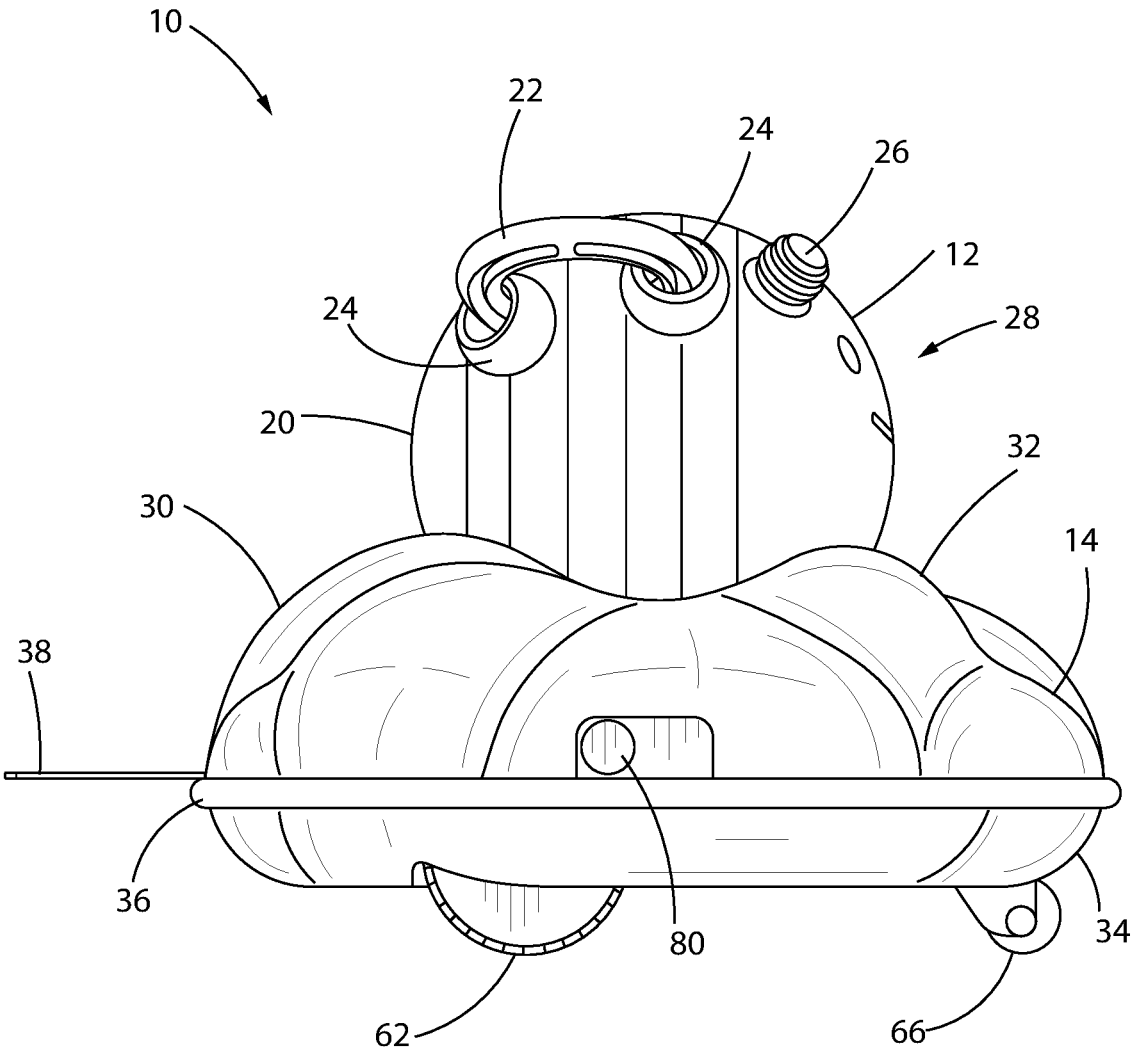
FIG. 4 is a side view of the children's toy of FIG. 1.
Figure 5:
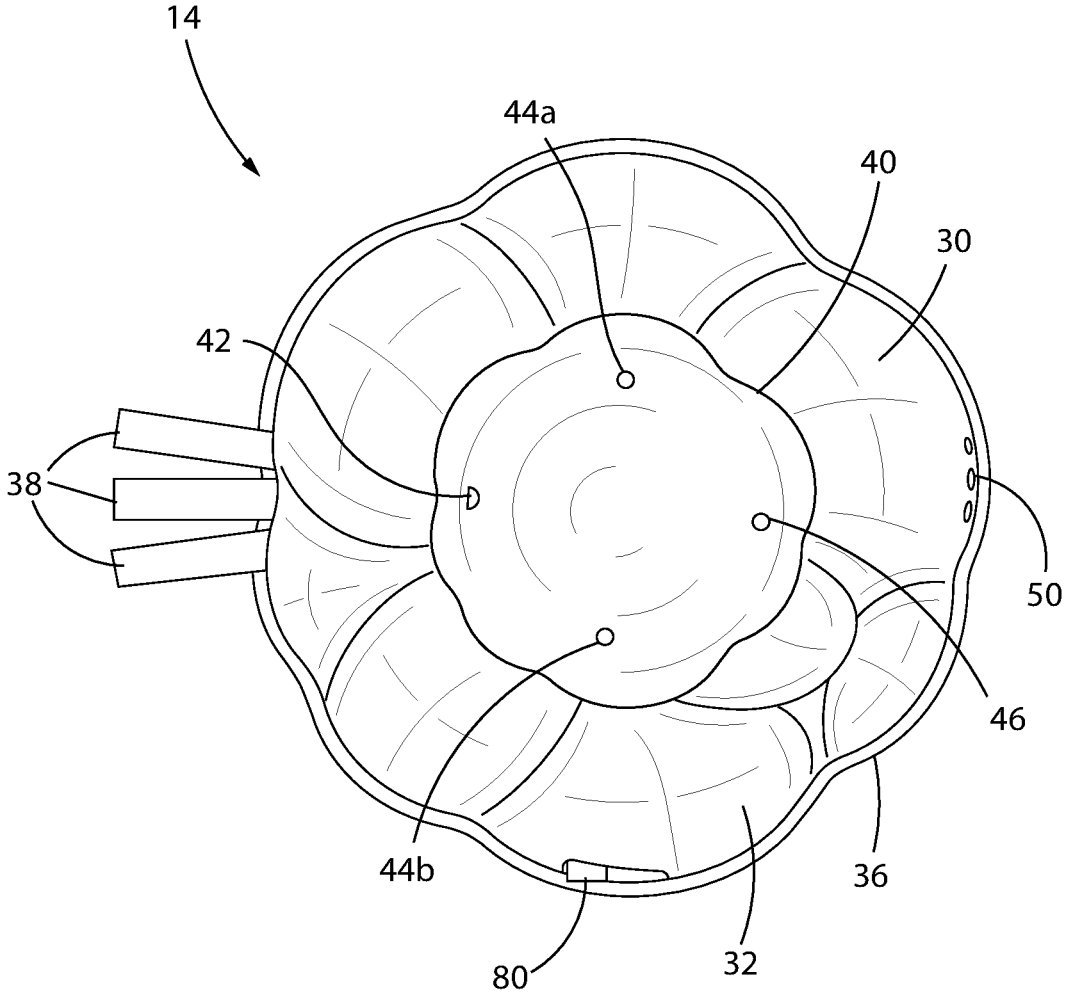
FIG. 5 is a top view of the base of the children's toy of FIG. 1.

As perhaps best shown in FIGS. 3 and 5, the upper portion 32 of the housing 30 defines a cradle 40 located substantially in the center of the upper portion 32 of the housing 30 with the cradle 40 configured to house the removable member 12. Within the cradle 40 are two actuating pins 44*a*, 44*b* which, when the removable member 12 is positioned within the cradle 40, move up and down to alternately engage the removable member 12, causing the removable member 12 to bob up and down within the cradle 40. Furthermore, a button switch 46 (shown in FIG. 5) is positioned within the cradle 40 such that when the removable member 12 is positioned within the cradle 40, the removable member 12 depresses the button switch 46. As such, the button switch 46 provides feedback as to whether the removable member 12 is positioned within the cradle 40, as further discussed below. Although not expressly shown, each of the two actuating pins 44*a*, 44*b* and button switch 46 extend through a respective hole defined in the upper portion 32 of the housing 30 and are operably controlled by components located within the internal cavity of the housing 30. As shown in FIGS. 3 and 5, in this exemplary embodiment, there is a protrusion 42 at the rear of the cradle 40 which assists in properly seating the removable member 12; however, in other embodiments no such protrusion is present.

Figure 6:
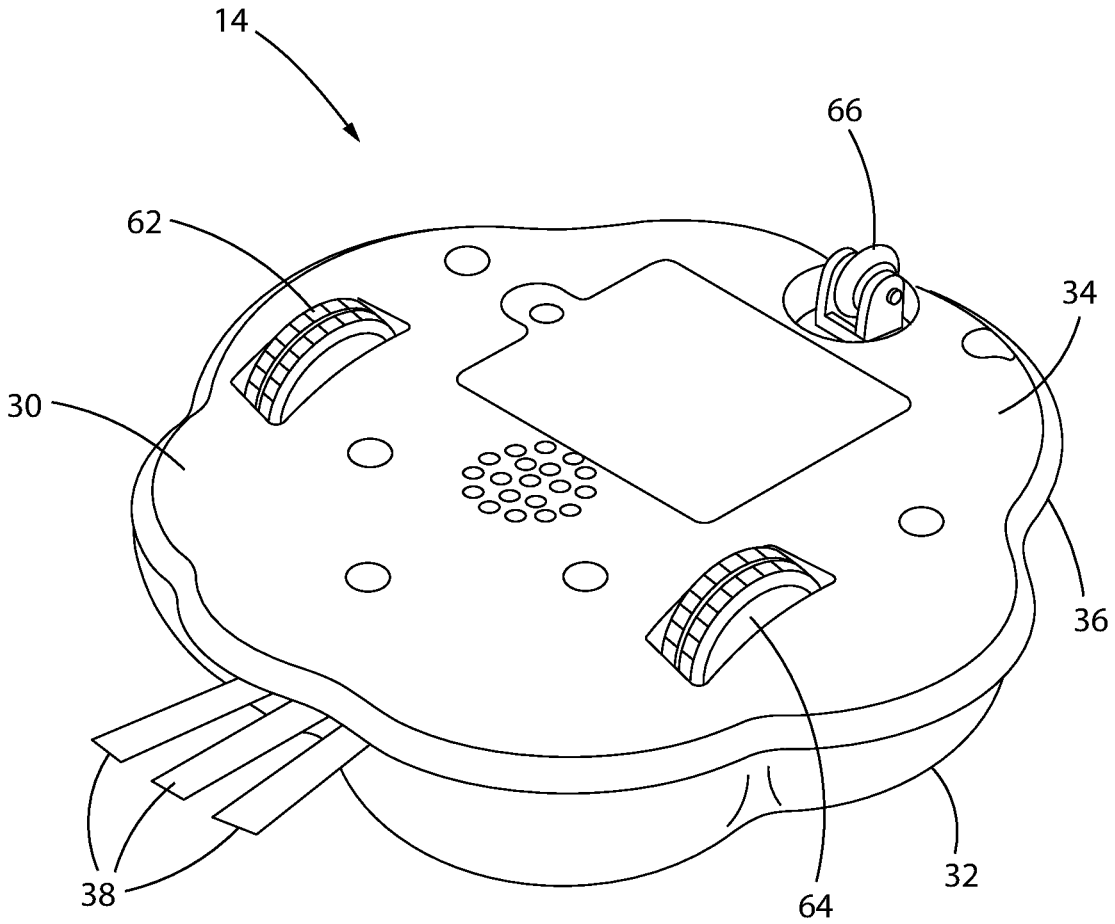
FIG. 6 is a bottom perspective view of the base of the children's toy of FIG. 1.

Referring now specifically to FIG. 6, the lower portion 34 of the housing 30 includes a driving mechanism, herein the form of wheels 62, 64, 66 which are configured to move the base 14 along a path, as further discussed below. In particular, the driving mechanism includes a first driving wheel 62 and a second driving wheel 64 positioned on either side of the lower portion 34 of the housing 30 and which are each individually controllable. At the front of the lower portion 34 is a pivot wheel 66, which, in this exemplary embodiment, is in the form of swivel caster which freely rotates in all directions and which helps support the base 14 while moving along the path.

In the exemplary base 14 shown in the Figures, the upper portion 32, the lower portion 34 or both are comprised of a rigid material, such as a plastic, whereas the bumper 36 is comprised of a semi-rigid material such as a rubber. Of course, other material choices are possible without departing form the spirit and scope of the present invention.

Figure 7:
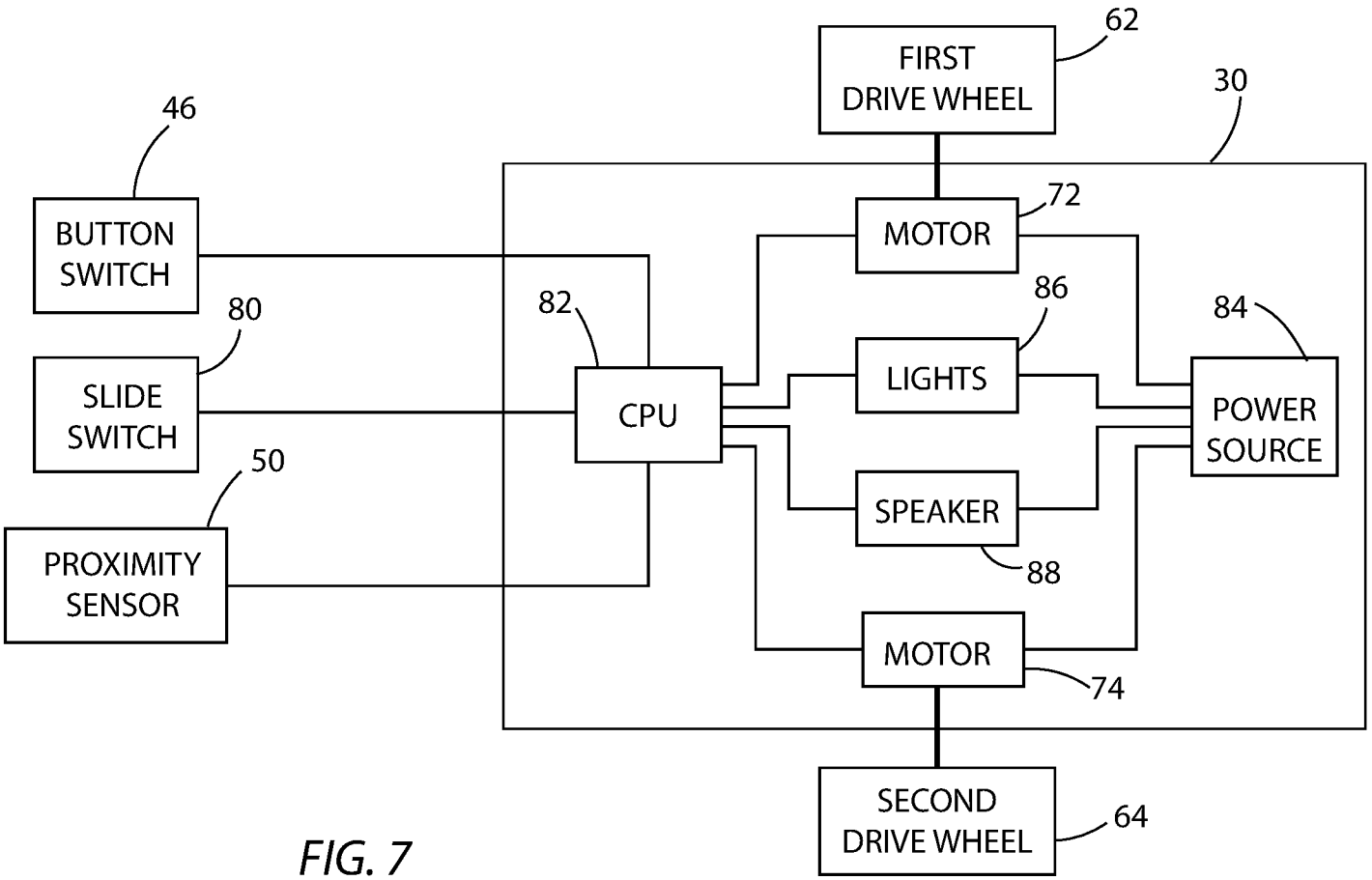
FIG. 7 is a schematic view of the electronic components of the children's toy of FIG.

Regardless of the particular compositions of the housing 30, as mentioned above, the housing 30 defines an internal cavity which contains various elements for controlling operation of the base 14. In particular, and referring now specifically to FIG. 7, the housing 30 contains a first motor 72 operably connected to the first driving wheel 62, a second motor 74 operably connected to the second driving wheel 64, a CPU 82 for controlling each of the motors 72, 74, and thus the driving wheels 62, 64, and a power source 84, such as batteries, for providing power to each of the motors 72, 74. As shown in FIG. 6, in this exemplary embodiment, the lower portion 34 of the housing 30 includes a door which is removable for accessing a battery compartment that contains one or more batteries. Referring still to FIG. 7, the housing 30 further contains one or more lights 86 visible through the upper portion 32 of the housing 30. To this end, in some embodiments of the present invention, the upper portion 32 of the housing 30 includes one or more translucent areas (not shown) which diffuse light emitted from an underlying light, illuminating an area of the upper portion 32 of the housing 30. The housing 30 further contains a speaker 88 for playing sounds and/or music, and, as shown in FIG. 6, the lower portion 34 of the housing 30 defines a plurality of holes that allow sound to readily transmit from the speaker 88 and through the housing 30. The power source 84 also supplies power to the one or more lights 86 and the speaker 88. The button switch 46 and proximity sensors 50 previously mentioned provide feedback to the CPU 82, and a slide switch 80 (also shown in FIGS. 1-5) located on the upper portion 32 of the housing 30 adjacent to the bumper 36 provides a means to not only to activate/deactivate the toy 10, but also to switch between multiple modes of use thereof, as further described below.

Referring now to the removable member 12 in particular, in this exemplary embodiment, the removable member 12 includes a substantially spherical body 20 which is weighted to maintain an upright position when placed on a substantially flat surface. That is to say, although not expressly shown in the Figures, the spherical body 20 defines an internal cavity which includes an offset weight that acts to bias the spherical body 20 into a predetermined orientation. Furthermore, the spherical body 20 includes elements (not shown) within the internal cavity that rattle when the removable member 12 is moved or shifted. On the exterior of the spherical body 20 and opposite the offset weight, i.e., on an upper side of the spherical body 20, are a plurality of engagement features. In the exemplary embodiment show in the Figures, the plurality of engagement features include two loops 22 in the shape of wings which each include a plurality of beads 24 which can move along the loops 22. Furthermore, two textured knobs 26 in the shape of antenna extend from the spherical body 20. Further still, a face 28, including two eyes and a mouth, is positioned on the exterior surface of the spherical body 20. As such, the removable member 12 is suggestive of an insect, such as a bee. Likewise, the shape of the base 14 is suggestive of a cloud. Of course, other configurations of the removable member 12 and/or base 14 are also contemplated, including shapes and engagement features which are suggestive of other insects, animals, or objects. In any event, the removable member 12 is configured for placement on the base 14, and in particular, within the cradle 40 defined in the upper portion 32 of the housing 30.

Various functions and operations of the toy 10 will now be described in further detail. Referring once again to FIG. 7 in particular, as previously mentioned, the slide switch 80 is used not only to activate/deactivate the toy 10, but also to switch between multiple modes of use thereof. In particular, the exemplary toy 10 shown in the Figures has a first mode and a second mode of operation, as described below. Furthermore, the button switch 46 within the cradle 40 provides feedback as to whether the removable member 12 is positioned within the cradle 40.

Figure 2:
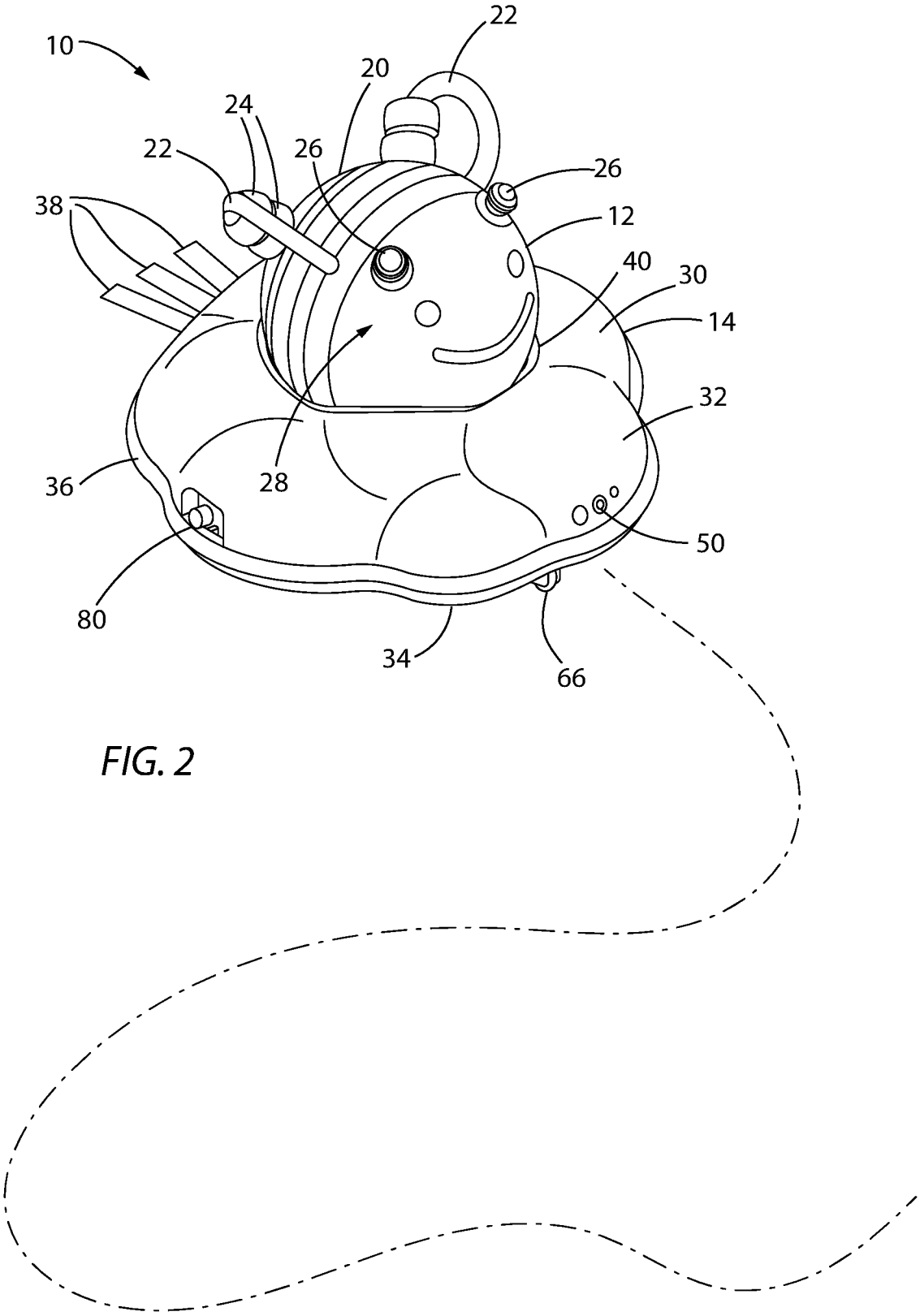
FIG. 2 is a perspective view of the children's toy of FIG. 1 moving along a second path.

In the first mode of operation, when the removable member 12 is positioned within the cradle 40, the base 14 moves along a first path. In one particular embodiment, and as shown in FIG. 1, the first path is substantially circular. That is to say, the CPU 82 directs each of the motors 72, 74 to spin the respective drive wheels 62, 64 in the forward direction at differential rates. In the second mode of operation, when the removable member 12 is positioned within the cradle 40, the base 14 moves along a second path. In one particular embodiment, and as shown in FIG. 2, the second path is substantially random. That is to say, the CPU 82 directs each of the motors 72, 74 to spin the respective drive wheels 62, 64 in the forward direction but at differential rates which change over time. While the base 14 moves along the first path or the second path the CPU 82 also directs each of the one or more lights 86 to display a patterned light display. Likewise, the CPU 82 also directed the speaker 88 to play sounds and/or music.

If the removable member 12 is subsequently removed from the cradle 40 while the base 14 is moving along the first path or the second path, the base 14 will begin rotating in place. That is to say, the CPU 82 directs each of the motors 72, 74 to spin the respective drive wheels 62, 64 in opposite directions at substantially the same rate. Likewise, if the removable member 12 is not positioned within the cradle 40 when the slide switch 80 is first moved from an "off" position to an "on" position (i.e., either the first mode of operation or a the second mode of operation), the base 14 will rotate in place. Upon placing the removable member 12 within the cradle 40, the base 14 will begin to move along the first path or the second path, depending on which of the two modes of operation the toy 10 is set.

As a further advantage of the present invention, and as previously mentioned, the base 14 further includes proximity sensors 50 at the front of the housing 30 which are configured to detect objects in the path of the base 14. Through use of the sensors 80, the CPU 82 determines whether the base 14 is about to run into another object and adjusts the path of the base 14 to avoid the object.

One of ordinary skill in the art will recognize that additional embodiments are also possible without departing from the teachings of the presently-disclosed subject matter. This detailed description, and particularly the specific details of the exemplary embodiments disclosed herein, is given primarily for clarity of understanding, and no unnecessary limitations are to be understood therefrom, for modifications will become apparent to those skilled in the art upon reading this disclosure and can be made without departing from the spirit and scope of the presently-disclosed subject matter.

What is claimed is:

1. A children's toy for promoting movement, the toy comprising:

a base having an upper portion and a lower portion;

a driving mechanism operably connected to the lower portion of the base, the driving mechanism configured to move the base along a plurality of paths;

a removable member configured for selective placement on the base; and one or more lights operably connected to the base, the one or more lights configured to display a patterned light display as the base moves along one of the plurality of paths;

wherein the base moves along the one of the plurality of paths when the removable member is placed on the base, and wherein, while the base is moving along the one of the plurality of paths, upon removing the removable member from the base, the base stops moving along the one of the plurality of paths and automatically begins rotating according to a second path.

2. The toy of claim 1, wherein the base houses a motor operably connected to the driving mechanism, a power supply for supplying power to the motor, and a CPU for controlling the motor to move the base along the plurality of paths.

3. The toy of claim 2, wherein the driving mechanism comprises one or more driving wheels, each of the one or more driving wheels operably connected to a separate motor.

4. The toy of claim 2, wherein the base further includes a proximity sensor configured to detect an object in the one of the plurality of paths of the base and, upon the proximity sensor detecting an object in the one of the plurality of paths of the base, the CPU adjusts the path to avoid the object.

5. The toy of claim 1, wherein the one of the plurality of paths is circular.

6. The toy of claim 1, wherein the one of the plurality of paths is random.

7. The toy of claim 1, wherein the base further includes a proximity sensor configured to detect objects in the one of the plurality of paths of the base.

8. The toy of claim 1, wherein each of the one or more lights is positioned within the base such that the one or more lights are visible through the upper portion of the base.

9. The toy of claim 1, wherein the upper portion of the base defines a cradle configured to house the removable member and the cradle includes a sensor which is depressed upon placing the removable member in the cradle.

10. The toy of claim 9, wherein the cradle includes one or more actuating pins configured move up and down to alternately engage the removable member within the cradle as the base moves along the one of the plurality of paths.

11. The toy of claim 1, wherein the removable member is substantially spherical.

12. The toy of claim 1, wherein the driving mechanism includes two driving wheels which spin in alternate directions to rotate the base.

13. The toy of claim 1, further comprising a speaker for play sounds and/or music as the base moves along the one of the plurality of paths.

14. A children's toy for promoting movement, the toy comprising:

a base configured for movement along one of a plurality of paths, the base including a sensor; and a removable member configured for placement on the base so as to trigger the sensor;

wherein, when the sensor is triggered by the removable member, the base follows a first path, and when the sensor is not triggered by the removable member, the base automatically follows a second path; and wherein the removable member is substantially spherical and weighted to maintain an upright position when placed on a substantially flat surface.

15. The toy of claim 14, wherein the first path is a circular path or a random path.

16. The toy of claim 14, wherein the second path is rotating the base in place.

17. A children's toy for promoting movement, the toy comprising:

a base defining a cradle, the base including one or more driving wheels, one or more motors, each of the one or more motors operably connected one of the one or more driving wheels, a power supply for supplying power to the one or more motors, and a CPU for controlling each of the motors; and a removable member configured for placement in the cradle;

wherein upon placing the removable member in the cradle, a sensor determines that the removable member is positioned within the cradle and the CPU directs the motors to drive the one or more driving wheels so as to move the base along a first path; and wherein upon removing the removable member from the cradle, the sensor determine that the removable member is no longer present in the cradle and the CPU directs the motors to change operation so as to move the base along a second path.

18. The toy of claim 17, wherein the sensor is a button switch which is depressed upon placing the removable member in the cradle.

19. The toy of claim 1, wherein the removable member is lifted from the base while the base is moving along the one of the plurality of paths.

* * * * *